United States Patent [19]

Spehrley, Jr.

[11] 4,181,248

[45] Jan. 1, 1980

[54] FIXED STAPLER HEAD

[75] Inventor: C. W. Spehrley, Jr., Quechee, Vt.

[73] Assignee: Xerox Corporation, Stamford, Conn.

[21] Appl. No.: 905,815

[22] Filed: May 15, 1978

[51] Int. Cl.[2] ..... B27F 7/06

[52] U.S. Cl. ..... 227/3; 227/5; 227/153

[58] Field of Search ..... 227/2, 3, 4, 5, 6, 7, 227/28, 30, 39, 40, 45, 99, 100, 101, 153

[56] References Cited

U.S. PATENT DOCUMENTS 3,474,947 10/1969 Readyhough ..... 227/7

3,685,712 8/1972 Turner et al. ..... 227/3

3,709,595 1/1973 Turner et al. ..... 227/40 X

*Primary Examiner*—Paul A. Bell

*Attorney, Agent, or Firm*—J. J. Ralabate; C. A. Green; H. Fleischer

[57] ABSTRACT

An apparatus in which a plurality of sheets are stapled to one another. The stapling frequency is dependent upon the number of sheets being stapled together.

The foregoing abstract is neither intended to define the invention disclosed in the specification, nor is it intended to be limiting as to the scope of the invention in any way.

17 Claims, 3 Drawing Figures

FIXED STAPLER HEAD

BACKGROUND OF THE INVENTION

This invention relates generally to an electrophotographic printing machine, and more particularly concerns an improved stapling system for use therein.

In an electrophotographic printing machine, a photoconductive member is charged to substantially uniform potential so as to sensitize the surface thereof. Thereafter, the charged portion of the photoconductive member is exposed to a light image of an original document being reproduced. Exposure of the charged photoconductive surface selectively discharges the charge thereon in the irradiated areas. This records an electrostatic latent image on the photoconductive surface corresponding to the informational areas contained within the original document being reproduced. After the electrostatic latent image is recorded on the photoconductive surface, the latent image is developed by bringing a developer mix into contact therewith. Toner particles are attracted from the carrier granules of the developer mix in image configuration on the latent image. Thereafter, the toner powder is transferred to the copy sheet. Finally, the copy sheet is heated to permanently affix the toner particles thereto in image configuration. This general approach was originally disclosed by Carlson in U.S. Pat. No. 2,297,691 and has been further amplified and described by many related patents in the art.

Frequently, it is highly desirable to produce a plurality of sets of copies with each set of copies corresponding to a set of original documents. This is generally achieved by employing a recirculating document handling system in association with the electrophotographic printing machine. The recirculating document handling system is positioned on the platen of the printing machine and advances successive original documents onto the platen so that they may be exposed, and, subsequently reproduced. Each original document, after being exposed, is returned to the stack of original documents so that it may be re-imaged for the next successive copying cycle. In this manner, collated sets of copies are formed.

Often it is desirable to secure the copies of each set to one another forming a booklet thereof. This may be achieved by stapling the copies to one another. In high speed electrophotographic printing machines, it is highly desirable to actuate the stapling system as rapidly as possible. Generally, the force required to drive the staple through the stack of sheets depends upon the thickness thereof. In a pneumatic system, the pressure increases at a function of time. Thus, it will take a longer time to staple a thicker stack of sheets than a thinner stack of sheets. Hence, if the stack of sheets contains a lesser number of copies, the force required to drive a staple therethrough will be available in a shorter time than if the stack contains a greater number of copy sheets. Hereinbefore, the stapling systems have all driven the staple into the stack at a fixed frequency. This frequency would, of course, be at the lowest rate corresponding to the maximum thickness or number of sheets in the stack. This reduces the efficiency of an electrophotographic printing machine.

Accordingly, its primary object of the present invention to improve the stapling apparatus is optimizing the stapling frequency.

Prior Art Statement

Various types of devices have hereinbefore been developed to improve stapling machines. The following prior art appears to be relevant:

Readyhough U.S. Pat. No. 3,474,947 Oct. 28, 1969

Turner et al. U.S. Pat. No. 3,685,712 Aug. 12, 1972

The pertinent portions of the foregoing prior art may be briefly summarized as follows:

Readyhough describes a pneumatic actuation system for a stapling apparatus.

Turner et al. discloses a stapling apparatus for stapling a set of copy sheets into booklets. The set of copy sheets are reproduced in an electrophotographic printing machine by the repeated copying of the original documents.

It is believed that the scope of the present invention, as defined by the appended claims, is patentably distinguishable over the foregoing prior art taken either singly or in combination with one another.

SUMMARY OF THE INVENTION

Briefly stated, and in accordance with the present invention, there is provided an apparatus for attaching a plurality of sheets to one another.

Pursuant to the features of the invention, the apparatus includes means for stapling the sheets to one another. Means are provided for periodically energizing the stapling means at a frequency dependent upon the number of sheets being stapled to one another.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
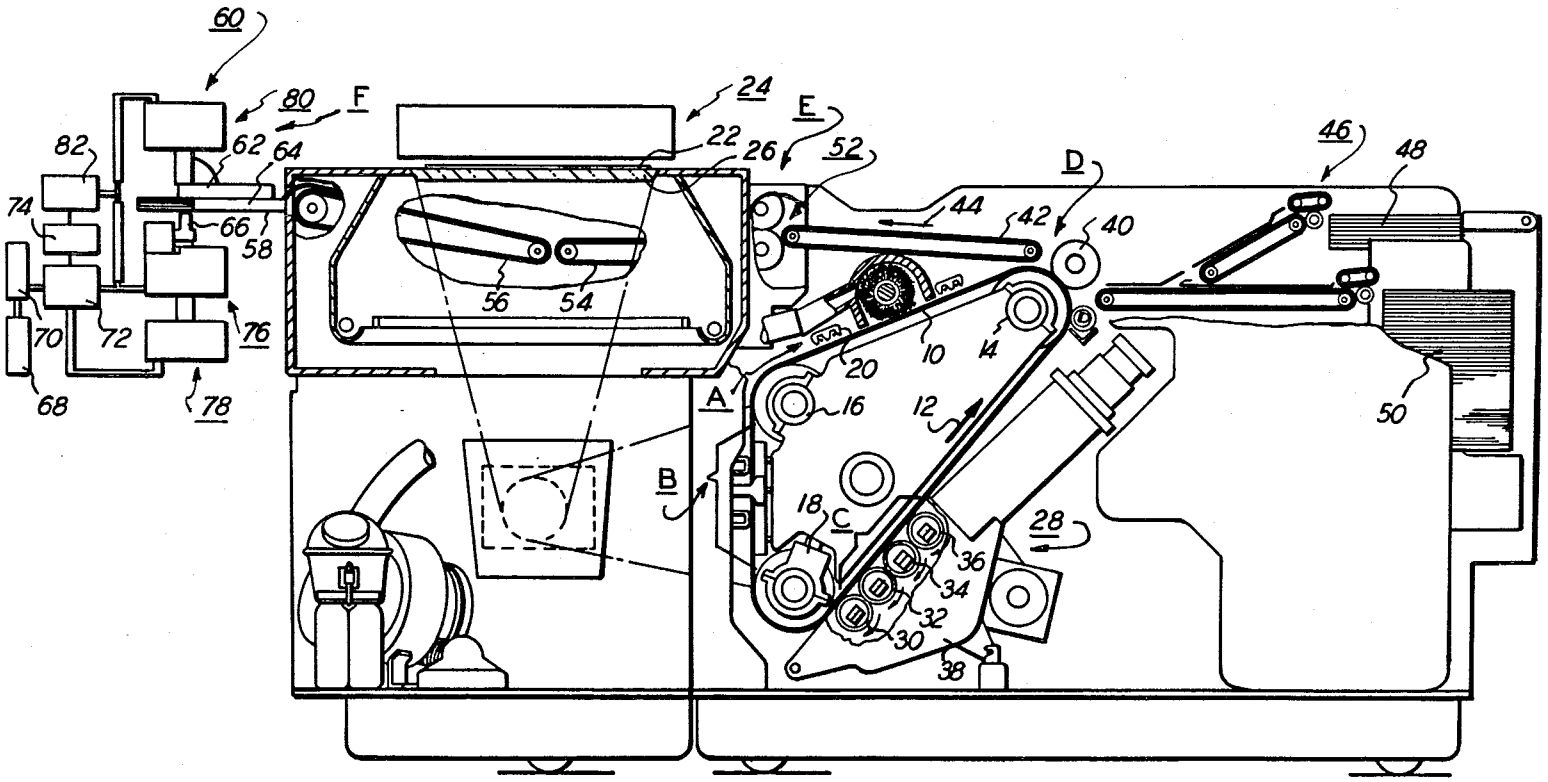
FIG. 1 is a schematic elevational view depicting an electrophotographic printing machine incorporating the features of the present invention therein.

For a general understanding of the illustrative electrophotographic printing machine incorporating the features of the present invention therein, references is had to the drawings. In the drawings, like reference numerals have been used throughout to designate identical elements. FIG. 1 schematically depicts the various components of an electrophotographic printing machine having the stapling apparatus of the present invention therein. Although the stapling apparatus is particularly well adapted for use in an electrophotographic printing machine, it will become evident from the following discussion that it is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface, e.g. a selenium alloy, deposited on a conductive substrate, e.g. aluminum. As shown in FIG. 1, belt 10 moves in the direction of arrow 12 to advance sequentially through the various processing stations disposed about the path of movement thereof. Rollers 14, 16 and 18 support belt 10. A drive mechanism, i.e. a suitable motor, is coupled to roller 14 and advances belt 10 in the direction of arrow 12.

Initially, a portion of belt 10 passes through charging station A. At charging station A a corona generating device, indicated generally by the reference numeral 20, charges the photoconductive surface of belt 10 to a relatively high, substantially uniform potential. A suitable corona generating device is described in U.S. Pat. No. 2,836,725 issued to Vyverberg in 1958.

Next, the charged portion of photoconductive belt 10 is advanced through exposure station B. At exposure station B, an original document 22 is advanced by a recirculating document handling system, indicated generally by the reference numeral 24, onto a transparent platen 26. Recirculating document handling system 24 stores a set of original documents. Successive original documents are advanced from the set and positioned face down on transparent platen 26. After the original document is exposed, it is returned to the top of the set of original documents by the recirculating document handling system for subsequent re-imaging. Preferably, recirculating document handling system 24 is the type described in U.K. Pat. No. 1,492,466, the relevant portions thereof being hereby incorporated into the present application. Recirculating document handling system 24 includes a circuit for counting the number of original documents in a set. Thus, a switch is employed in conjunction with a counter for determining the number of original documents being copied in each set. After the complete set of original documents has been copied, the counter is reset. In this manner, an electrical output signal is generated from the recirculating document handling system indicating the number of original documents in each set. This number corresponds to the number of copies being stapled together in each booklet. An exemplary counting arrangement may comprise a leaf switch which closes each time an original document passes thereover and a counter. In addition, the recirculating document handling system employs a set separator so that the original documents that have been reproduced are spaced from those that have not been reproduced. When the complete set of original documents have been reproduced, a second electrical signal is generated re-zeroing the counter. Each original document 22 positioned on transparent platen 26 is exposed by a lamp which flashes light rays thereon. The light rays reflected from original document 22 pass through the optics of the exposure system forming a light image containing the informational areas of the original document therein. The optics, e.g. suitable lens and mirrors, of the exposure system project the light image onto the charged portion of photoconductive surface of belt 10. In this manner, the charged photoconductive surface of belt 10 is discharged selectively by the light image of the original document. This records an electrostatic latent image on the photoconductive surface of belt 10 which corresponds to the informational areas contained within original document 22.

Thereafter, belt 10 advances the electrostatic latent image recorded on the photoconductive surface thereof to development station C. At development station C, developer unit 28 comprising a plurality of magnetic brush developer rollers 30, 32, 34 and 36 disposed in housing 28 which advance a developer mix into contact with the electrostatic latent image recorded on the photoconductive surface of belt 10. The developer mix comprises carrier granules having toner particles adhering triboelectrically thereto. Each magnetic brush developer roller forms a chain-like array of developer mix extending in an outwardly direction therefrom. The developer mix contacts the electrostatic latent image recorded on the photoconductive surface of belt 10. The latent image attracts the toner particles from the carrier granules forming a toner powder image on the photoconductive surface of belt 10.

The toner powder image recorded on the photoconductive surface of belt 10 is then transported to transfer station D. Transfer station D is located at a point of tangency on belt 10 as it moves around roller 14. A transfer roller 40 is located at transfer station D with the copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the description of fixing station E, the sheet feeding apparatus will be briefly described. The sheet feeding apparatus includes a sheet transport 46 which advances, in seriatum, successive copy sheets from stack 48 or, in lieu thereof, stack 50. The machine programming enables the operator to select the desired stack from which the copy sheets will be advanced. Thus, the selected copy sheet is advanced to transfer station D where the toner powder image adhering to the photoconductive surface of belt 10 is transferred thereto.

Fixing station E includes a fuser assembly, indicated generally by the reference numeral 52. Fuser assembly 52 comprises a heated fuser roll and back-up roll. The copy sheet having the toner powder image thereon passes between the fuser roll and the back-up roll with the toner powder image contacting the fuser roll. In this manner, the toner powder image is permanently affixed to the copy sheet. After fusing, conveyors 54 and 56 advance the copy sheet to finishing station F.

Finishing station F includes a tray 58 for receiving, stacking, and jogging the copy sheets into an ordered set. After the recirculating document handling system indicates that all of the original documents have been copied, it develops an electrical signal corresponding to the number of original documents copied. In response to this electrical signal, a stapling apparatus, indicated generally by the reference numeral 60, secures the set of copy sheets into a booklet. Stapling apparatus 60 is actuated penumatically at a frequency dependent upon the number of sheets of the thickness of the stack being stapled. As shown in FIG. 1, stapling apparatus 60 comprises a stapler 62 in engagement with the stack of copy sheets 64 which are clamped by clamping apparatus 66. A clinching mechanism, not shown, folds the legs of the staples into engagement with the copy sheet after the staple have been driven through the stack by stapler head 62. A pressure source or compressor 68 is coupled to accumulator 70. Valve 72, actuated by controller 74, periodically couples clamper 76 and driver 80 to accumulator 70. In addition, controller 74 also regulates valve 72 to periodically couple the pneumatic driving mechanism 76 and 80 to clinching driver 78. In operation, a signal from recirculating document handling system 24 indicates the number of original documents that have been copied. This indicates the frequency at which the stapling mechanism should be actuated. Controller 74 regulates the switching of valve 72 in accordance therewith. Initially, valve 72 is actuated so that clamper 76 moves clamping mechanism 66 into engagement with the stack of sheets 64 on tray 58. This presses the stack of sheets into engagement with stapler head 62. Simultaneously valve 72 energizes pneumatic system 80 associated with stapler head 62. This provides the requisite force to drive a staple through the stack of sheets. As previously noted, the required force is dependent upon the thickness of the article or number of sheets contained therein. The greater the number of sheets, the higher the required force. After the staple has been driven through the stack of sheets disposed on tray 58, controller 74 closes the input of valve 72 and opens the output, thus coupling clinching mechanism 78 with the pressurized fluid exhausting from clamper 76 and stapler 80. This, exhausting pressurized fluid, actuates the clinching mechanism to fold the stapler legs into engagement with the bottom of the stack of sheets. Thereafter, pressure source 68 supplies additional pressurized fluid to accumulator 70 so that the pressure therein builds to the requisite magnitude. The duration required for the pressure build-up is dependent upon the force required to drive the staple through the stack of sheets. This, in turn, is dependent upon the thickness or number of sheets. The staple frequency is inversely dependent upon the number of sheets, i.e., the stapler may be actuated at a lower pressure or at a short time duration when the number of sheets are fewer. After the foregoing operations are completed and prior to the next successive stapling apparatus, controller 74 opens valve 82 to exhaust the pressurized fluid from clincher 78 and clamper 76 and driver 80. By way of example, the pressurized fluid may be air. The detailed structure of the stapling apparatus will be discussed hereinafter with reference to FIG. 2.

Figure 2:
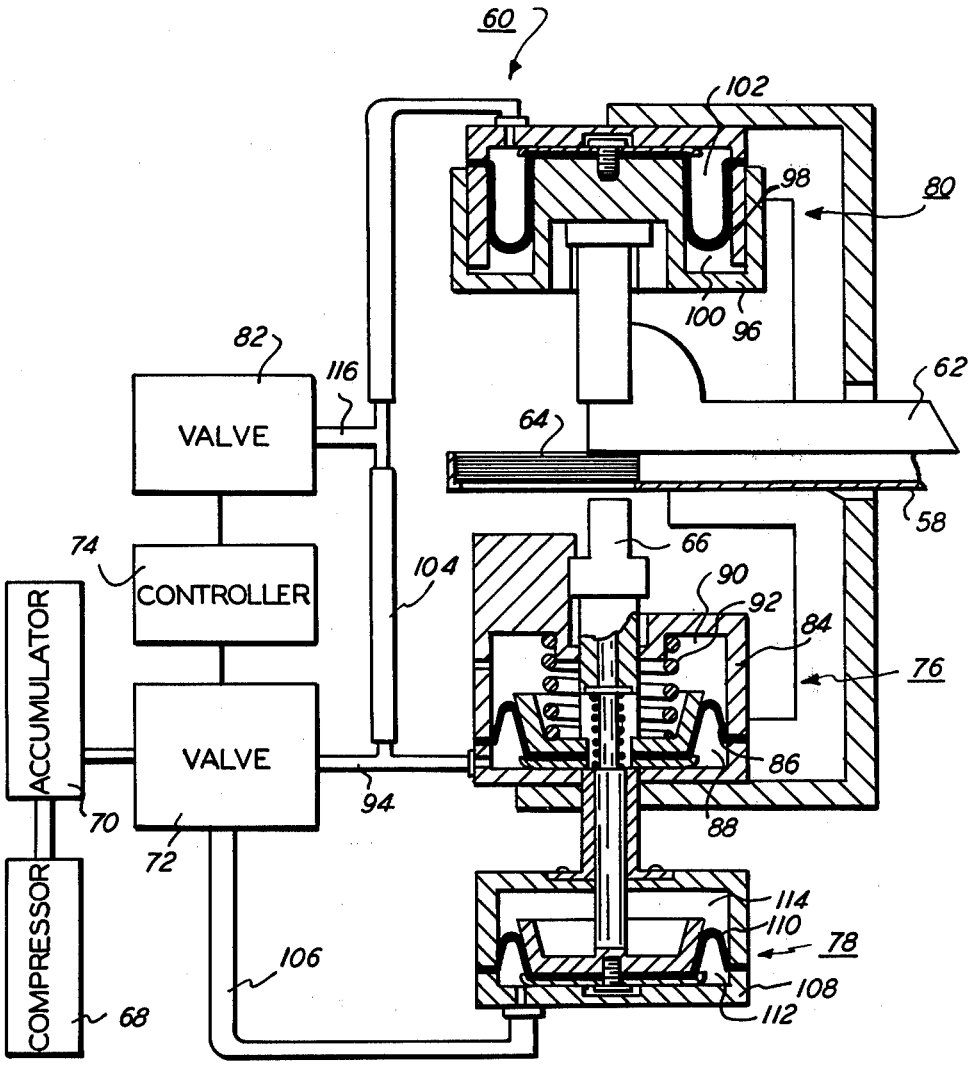
FIG. 2 is a schematic elevational view illustrating the operation of a stapling apparatus employed in the FIG. 1 printing machine.

Referring now to FIG. 2, stapling apparatus 60 includes a pneumatic drive 78 for moving clamper 66 into engagement with the stack 64 disposed on tray 58. Pneumatic drive 76 comprises a housing 84 defining an internal chamber thereof. A flexible diaphragm 86 divides the chamber of housing 84 into two compartments 88 and 90. Pressurized fluid admitted into chamber 88 causes diaphragm 86 to expand moving clamper 66 into engagement with stack 64 and securing it against stapler head 62. Chamber 90 is vented to atmosphere. A compression spring 92 returns clamper 66 to its normal position spaced from stack 64 when the pressurized fluid is exhausted from chamber 88. In operation, controller 74 opens one of the ports of valve 72 coupling accumulator 70 with chamber 88 via conduit 94. This causes diaphragm 86 to expand moving clamper 66 into engagement with stack 64.

Stapler 62 is actuated by pneumatic mechanism 80. Pneumatic mechanism 80 comprises a housing 96 defining a chamber therein. Diaphragm 98 divides the chamber of housing 96 into two compartments 100 and 102. The admission of pressurized fluid into chamber 102 causes disphragm 98 to expand energizing stapler head 62 to drive a staple through stack 64. In operation, when valve 72 opens output port coupling conduit 94 to accumulator 70, it also couples conduit 104 to accumulator 70. This causes pressurized fluid to flow from accumulator 70 to chamber 102 expanding diaphragm 98. As diaphragm 98 expands, it actuates stapler head 62 driving a staple through the stack of sheets 64 disposed on tray 58. Chamber 100 is vented to atmosphere permitting air to escape therefrom. When the pressurized fluid is exhausted from chamber 102, stapler head 62 returns to its normal position so that it may be re-actuated for driving the next successive staple through the stack of sheets. By way of example, stapler head 62 is preferably Model No. 62E, manufactured by the Bostich Corporation.

After the staple has been driven through the stack of sheets, the input port to valve 72 is closed de-coupling the system from accumulator 70. At this time, the output port to conduit 106 is opened. This exhausts the pressurized fluid from chambers 88 and 102 into pneumatic system 78 for driving the clinching mechanism. This system comprises a housing 108 defining an internal chamber. A flexible diaphragm 110 divides the internal chamber of housing 108 into compartments 112 and 114. Compartment 114 is vented to atmosphere permitting air to escape therefrom, whereas compartment 112 is coupled to conduit 106 so as to receive the exhausting pressurized fluid from chambers 102 and 88. The exhaust pressurized fluid from the foregoing chambers causes diaphragm 110 to expand driving the clinching mechanism so as to fold the stapler legs into engagement with the bottom sheet of the stack. A suitable clinching mechanism is described in U.S. Pat. No. 3,474,947, the relevant portions thereof being hereby incorporated into the present application.

Thereafter, controller 74 actuates valve 82 to open its input port coupling conduit 116 to conduit 104. This vents the pressurized fluid in chambers 112, 88 and 102 to atmosphere. Compressor 68 now increases the pressure in accumulator 70 for the stack of the next stapling operation. In this way, the stapling apparatus 60 is prepared to drive the next successive staple through the stack of sheets.

Figure 3:
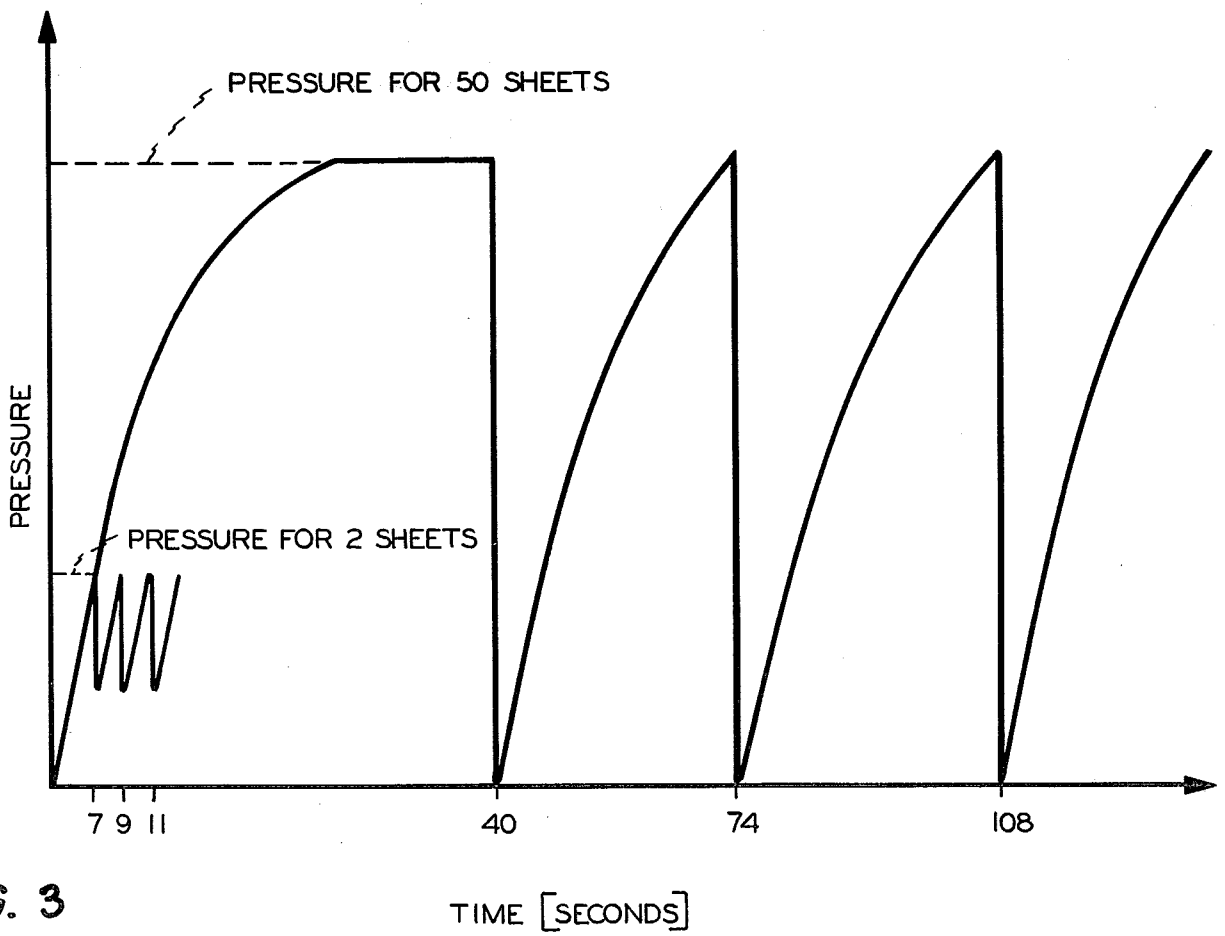
FIG. 3 is a graph showing the stapling frequency as a function of the number of sheets being stapled together.

Referring now to FIG. 3, there is shown a graph of pressure versus time and the number of sheets being stapled. As depicted thereat, it requires approximately 34 seconds to develop sufficient pressure in the accumulator to staple 50 sheets to one another. Contrawise, it requires only 2 seconds for the accumulator to develop sufficient pressure to staple two sheets to one another. However, it requires 7 seconds to build up sufficient pressure in the accumulator to initiate the two sheet cycle whereas it requires approximately 40 seconds to build up sufficient pressure in the accumulator for the 50 sheet cycle. Generally, the stapling frequency is 1.5 divided by the number of sheets in the stack plus 1. The stapling frequency is inversely proportional to the number of sheets or the thickness of the stack. The thicker or the more the number of sheets in the stack, the greater the force required to drive a stable therethrough and the longer the time duration required to build sufficient pressure in the accumulator to accomplish the foregoing. This greater time decreases the stapling frequency. Contrawise, the thinner the stack or the less the number of sheets contained therein, the greater the stapling frequency. Hence, for a fixed size accumulator, the stapler head may be actuated at different frequencies depending upon the number of sheets contained in the stack. In this manner, the stapling frequency is optimized as a function of the number of sheets being attached to one another.

In recapitulation, it is evident that the stapling apparatus of the present invention is actuated at a frequency dependent upon the number of sheets in the stack. Thus, the thickness of the stack determines the stapling frequency. The stapling frequency increases as the thickness of the stack decreases. The foregoing enables the stapling frequency to be optimized for differing numbers of sheets. In this manner, the stapling frequency for a stack comprising less sheets may be greater than the stapling frequency for a stack comprising a greater number of sheets. This insures that the stapling apparatus is not a limitation on the output capabilities of the electrophotographic printing machine.

It is, therefore, evident that there has been provided, in accordance with the present invention, a stapling apparatus that fully satisfies the objects, aims and advantages hereinbefore set forth. Although this invention has been described in conjunction with a specific embodiment thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for attaching a plurality of sheets to one another, including:

means for stapling the sheets to one another; means for controlling said stapling means; and means for detecting the number of sheets being stapled to one another, said detecting means providing a signal to said controlling means for periodically energizing said stapling means at a frequency dependent upon the number of sheets being stapled to one another.

2. An apparatus for attaching a plurality of sheets to one another, including:

means for stapling the sheets to one another; and means for periodically energizing said stapling means at a frequency dependent upon the number of sheets being stapled to one another, said energizing means comprises a source of pressurized fluid in communication with said stapling means, said pressurized fluid source increasing the fluid pressure as a function of time, and means for controlling said pressurized fluid source to periodically actuate said stapling means at the stapling frequency.

3. An apparatus as recited in claim 2 wherein the stapling frequency is inversely portional to the number of sheets being stapled to one another.

4. An apparatus as recited in claims 2 or 3, wherein said stapling means includes:

means for clamping the sheets;

means for driving a staple through the clamped sheets; and means for clinching the portion of the staple legs protruding through the sheets.

5. An apparatus as recited in claims 2 or 3, wherein said controlling means include:

means for generating a signal indicating the number of sheets being stapled to one another; and means, responsive to the signal from said generating means, for periodically coupling said fluid pressurized source to said stapling means so as to actuate said stapling means at the stapling frequency.

6. An apparatus as recited in claim 2, wherein stapling frequency is about 1.5 divided by the number of sheets being stapled plus 1.

7. A reproducing machine of the type producing stapled sets of copies from a set of original documents with each original document being advanced from a supply source to an exposure platen and returned to the supply source in repeated cycles, wherein the improved stapling apparatus includes:

means for stapling the sheets to one another; means for controlling said stapling means; and means for detecting the number of sheets being stapled to one another, said detecting means providing a signal to said controlling means for periodically energizing said stapling means at a frequency dependent upon the number of sheets being stapled to one another.

8. A reproducing machine of the type producing stapled sets of copies from a set of original documents with each original document being advanced from a supply source to an exposure platen and returned to the supply source in repeated cycles, wherein the improved stapling apparatus includes:

means for stapling the sheets to one another; and means for periodically energizing said stapling means at a frequency dependent upon the number of sheets being stapled to one another, said energizing means comprises a source of pressurized fluid in communication with said stapling means, said pressurized fluid source increasing the fluid pressure as a function of time, and means for controlling said pressurized fluid source to periodically actuate said stapling means at the stapling frequency.

9. A reproducing machine as recited in claim 8, wherein the stapling frequency is inversely portional to the number of sheets being stapled to one another.

10. A reproducing machine as recited in claim 8 or 9, wherein said stapling means include:

means for clamping the sheets;

means for driving a staple through the clamped sheets; and means for clinching the portion of the staple legs protruding through the sheets.

11. A reproducing machine as recited in claims 8 or 9, wherein said controlling means include:

means for generating a signal indicating the number of sheets being stapled to one another; and means, responsive to the signal from said generating means, for periodically coupling said fluid pressurized source to said stapling means so as to actuate said stapling means at the stapling frequency.

12. A reproducing machine as recited in claim 8, wherein the stapling frequency is about 1.5 divided by the number of sheets being stapled plus 1.

13. An apparatus for attaching at least two articles to one another, including:

means for stapling the articles to each other; means for controlling said stapling means; and means for detecting the combined thickness of the articles being stapled together, said detecting means providing a signal to said controlling means for periodically energizing said stapling means at a frequency dependent upon the combined thickness of the articles being stapled together.

14. An apparatus for attaching at least two articles to one another, including:

means for stapling the articles to each other; and means for periodically energizing said stapling means at a frequency dependent upon the combined thickness of the articles being stapled together, said energizing means comprises a source of pressurized fluid in communication with said stapling means, said pressurized fluid source increasing the fluid pressure as a function of time, and means for controlling said pressurized fluid source to periodically actuate said stapling means at the stapling frequency.

15. An apparatus as recited in claim 14, wherein stapling frequency is inversely portional to the combined thickness of the articles being stapled to one another.

16. An apparatus as recited in claims 14 or 15, wherein said stapling means include:

means for clamping the articles;

means for driving a staple through the clamped articles; and means for clinching the portion of the staple legs protruding through the articles.

17. An apparatus as recited in claims 14 or 15, wherein said controlling means include:

means for generating a signal indicating the combined thickness of the articles being stapled to one another; and means, responsive to the signal from said generating means, for periodically coupling said fluid pressured source to said stapling means so as to actuate said stapling means at the stapling frequency.

* * * * *